United States Patent [19]

Real

[11] 4,011,814

[45] Mar. 15, 1977

[54] PRINT STOCK GUIDE FOR IMPACT PRINTERS

[75] Inventor: Kenneth G. Real, Redmond, Wash.

[73] Assignee: Interface Mechanisms, Inc., Mountlake Terrace, Wash.

[22] Filed: Nov. 13, 1975

[21] Appl. No.: 631,744

[52] U.S. Cl. ..... 101/288; 197/133 R; 226/196; 242/76

[51] Int. Cl.[2] ..... B41F 1/08

[58] Field of Search ..... 101/288–295, 101/138–139, 178–182, 219–220, 253; 221/69–74; 226/15, 196–199; 242/76, 157 R; 197/133 R, 133 T

[56] References Cited

UNITED STATES PATENTS

| | | | |
|---|---|---|---|
| 2,522,224 | 9/1950 | Hedinger | 101/288 |
| 2,916,228 | 12/1959 | Wellington | 242/76 |
| 3,762,317 | 10/1973 | Hamisch | 101/288 |

*Primary Examiner*—Edgar S. Burr
*Assistant Examiner*—A. Heinz
*Attorney, Agent, or Firm*—Christensen, O'Connor, Garrison & Havelka

[57] ABSTRACT

An impact printer is disclosed for imprinting characters in succession on print stock such as that comprising an elongated strip of label stock backing having a lower edge surface, an upper edge surface, a front surface and a back surface and further comprising a plurality of labels removably adhering to and spaced along a front surface of the elongated strip. The impact printer moves the print stock under tension along a predetermined path past a print station including a hammer capable of controllable, reciprocative movement in a predetermined plane to contact the back surface of the print stock. In order to maintain the print stock properly aligned in a vertical direction with respect to the hammer as it moves in its predetermined plane, a first guide includes a planar reference surface normal to the predetermined plane and is located in proximity to the print station and to the predetermined path of print stock movement. A second guide is located in proximity to the print station for urging the lower edge surface of the print stock into contact with the reference surface. The second guide includes a surface, against which the front surface of the label stock is pressed, whose vertical dimension is normal to the reference surface at a location adjacent the print station and which is inclined with respect to that normal at a location adjacent the supply position.

11 Claims, 8 Drawing Figures

Fig. 1.
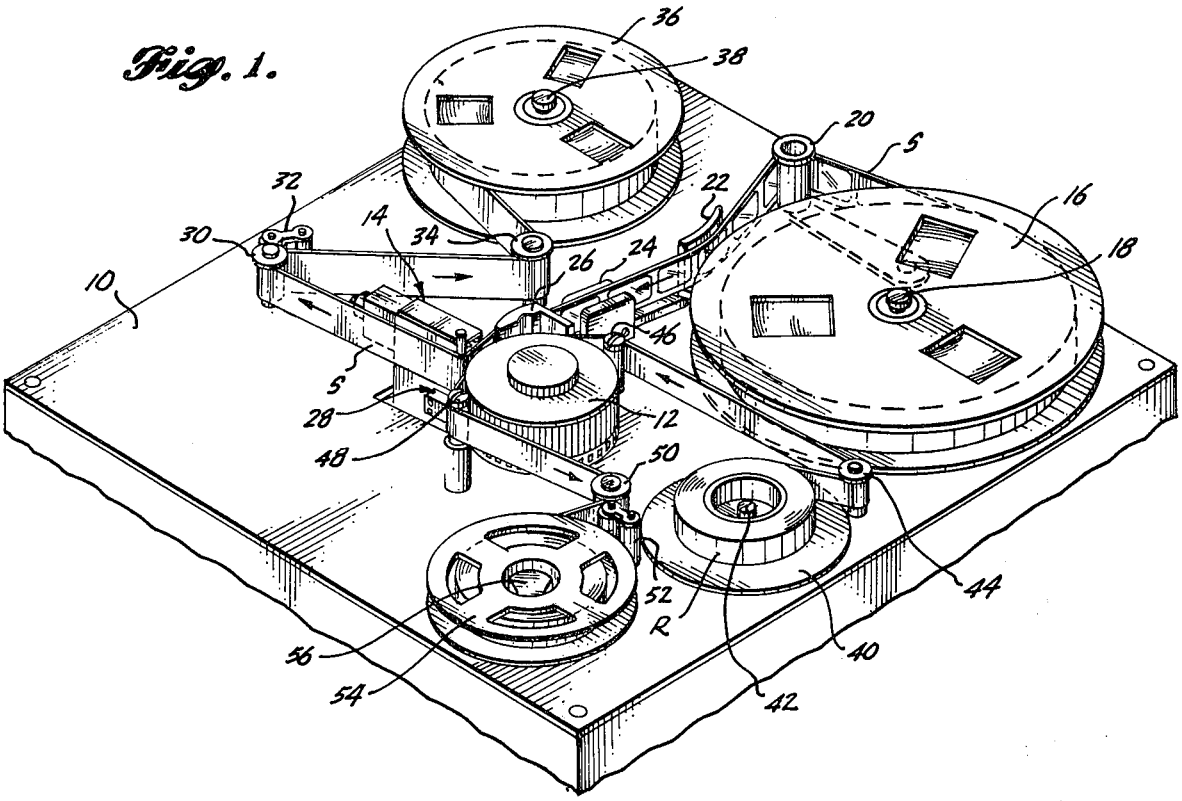
Fig. 2.
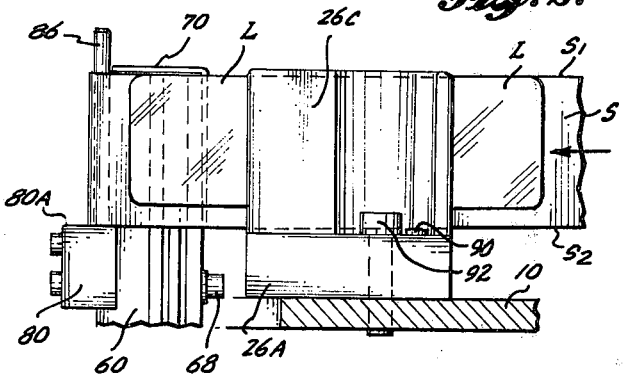
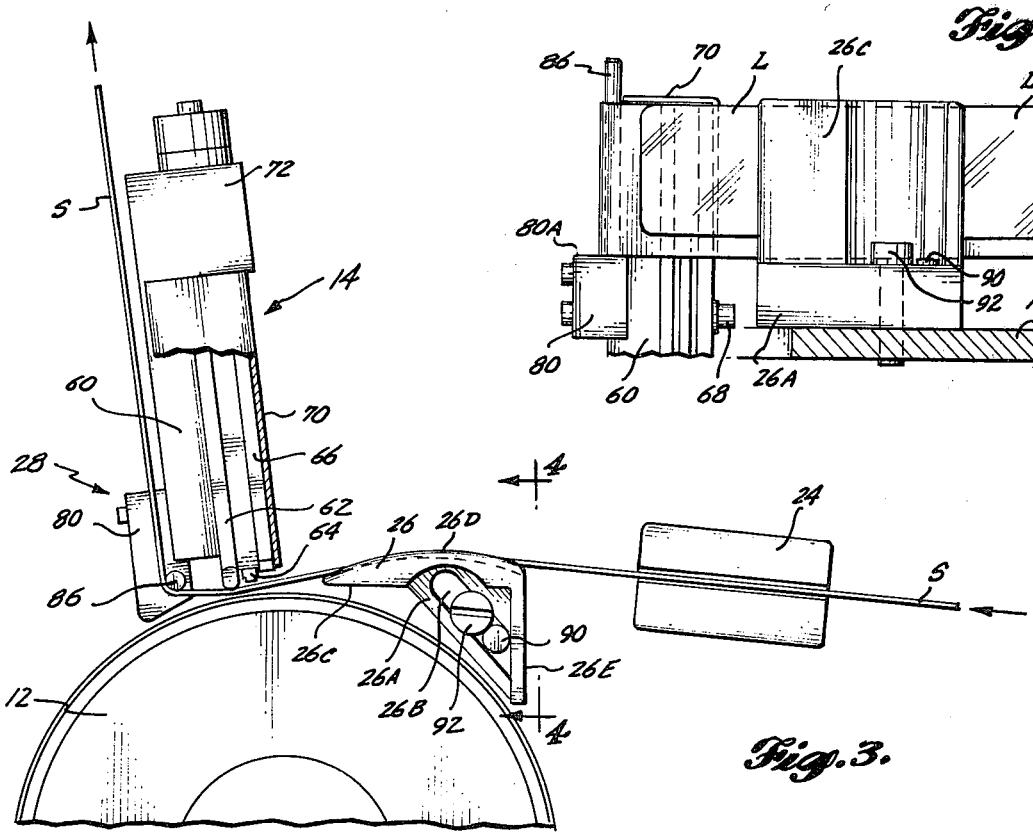
Fig. 3.

PRINT STOCK GUIDE FOR IMPACT PRINTERS

FIELD OF THE INVENTION

This invention generally relates to the field of mechanical impact printers, and more specifically, to an improved print stock guide useful in conjunction with such impact printers.

BACKGROUND OF THE INVENTION

Mechanical impact printers are known to the prior art for imprinting a succession of characters, which may be expressed in the form of a bar code or the like, on a succession of labels which removably adhere to an elongated strip of label stock backing. In such printers, the elongated strip is moved under tension along a predetermined path past a print station where the characters are successively imprinted. The print station may include a continuously rotating, cylindrical print wheel having located on a circumferential surface thereof a plurality of raised elements representing the characters to be imprinted, and a hammer mechanism including a hammer which has a selectively controllable, reciprocative movement in the predetermined plane whereby the hammer during its travel impacts the elongated strip and an interposed ink ribbon against one of the elements on the print wheel, resulting in imprinting of a single character.

To insure accurate and precise registration of successive characters on a label in a horizontal direction, or parallel to the predetermined path of label stock movement and to the direction of elongation thereof, the label stock backing must be vertically aligned with the print station including the aligned printed wheel and hammer mechanism. In the prior art, this alignment has been accomplished by the provision of a horizontal reference surface, which defines a plane extending at right angles to the plane of reciprocative movement of the hammer, against which the lower edge of the label stock backing bears during imprinting and label stock movement. It has been found, however, that the label stock backing will tend to rise or otherwise shift in a vertical direction from the horizontal reference surface during horizontal movement, with resulting misregistration of successive characters on a label. One solution to this problem would be the provision of a second horizontal reference surface for maintain the top surface of the label stock backing to maintain the vertical alignment thereof. However, the provision of such a second horizontal reference surface poses problems in that the label stock backing may often bind or be distorted during horizontal movement. In addition, the loading of label stock is made more difficult due to the necessity for inserting the label stock between the first and second horizontal reference surfaces.

It is therefore an object of this invention to provide an improved guide means for an impact printer which serves to maintain the vertical alignment of an elongated strip of print stock with respect to the vertical position of a print station including a hammer mechanism and a continuously rotating print wheel.

It is further object of this invention to provide such a guide means which does not bind or distort the print stock during movement past the print station.

It is yet a further object of this invention to provide such a guide means which is simple of construction and inexpensive of manufacture.

SUMMARY OF THE INVENTION

Briefly, in one embodiment of the invention, a print stock guide means for use with impact printers is provided which comprises a body having a base portion including means for permitting the print stock guide means to be secured to an impact printer and further having a guide portion upstanding from and integral with the base portion, the guide portion having a guide surface which is parallel in a first direction to an arbitrary reference line at a first end and which has an angle of inclination with respect to the arbitrary reference line which increases in a second direction of the guide surface, to a predetermined value at the second end.

The invention also resides in a first guide means located in proximity to a print station of an impact printer including a hammer movable in a predetermined plane for imprinting characters on print stock comprising an elongated strip having a lower edge surface, an upper edge surface, a front surface and a back surface. The first guide means includes a substantially planar reference surface normal to the predetermined plane of movement of the hammer. A second guide means is provided which is located in proximity to the print station between a supply position of the print stock and the print station for urging the lower edge surface of the print stock into contact with the planar reference surface as the print stock is moved by the impact printer along a predetermined path. The second guide means includes a first guide surface located in proximity to the supply position and having a predetermined angle of inclination with respect to a normal drawn to the planar reference surface and a second guide surface located intermediate the first guide surface and the print station and having a substantially zero angle of inclination with respect to a normal to the planar reference surface, the first and second guide surfaces being located with respect to the predetermined path so as to engage one of the front and back surfaces of the print stock.

BRIEF DESCRIPTION OF THE DRAWINGS

The invention can best be understood by reference to the following portion of the specification, taken in conjunction with the accompanying drawings, in which:

FIG. 1 is a pictorial view of an impact printer including the improved guide means of the present invention;

FIG. 2 is a front elevational view showing the vertical relationship of the improved guide means, the print stock, and the hammer mechanism of the impact printer;

FIG. 3 is a top plan view showing the horizontal relationship of the improved guide means and the print station of the impact printer;

DESCRIPTION OF A PREFERRED EMBODIMENT

Figure 4:
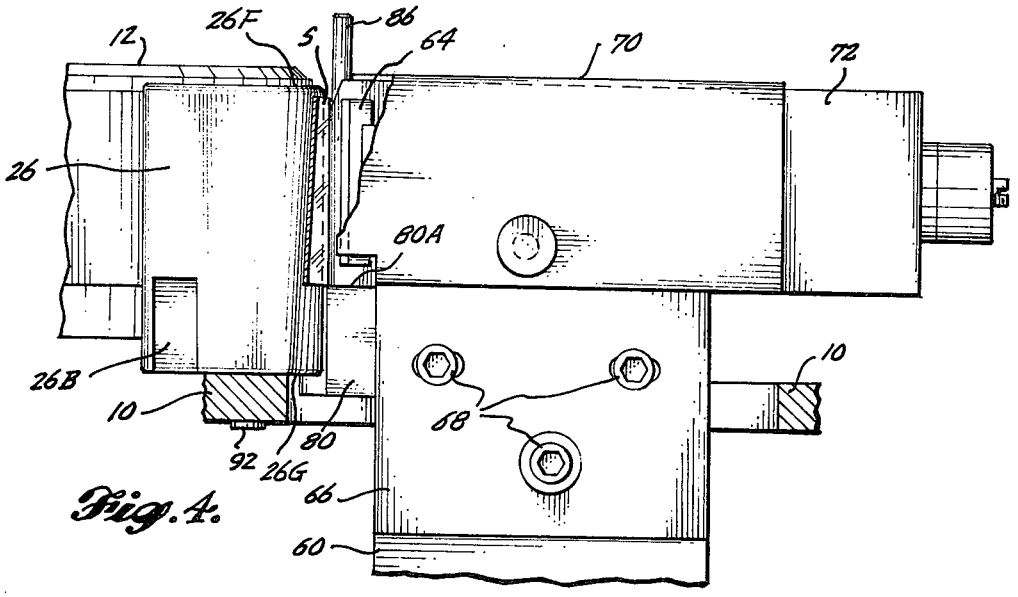
FIG. 4 is a side elevational view showing the vertical relationship of the improved guide means and the print station.

Referring now to FIG. 1, an impact printer includes a base plate 10 above which a print wheel 12 is supported for rotation. The circumferential surface of print wheel 12 has located thereon a plurality of raised elements representing the characters to be imprinted and is continuously rotated by a drive means, not illustrated. A hammer mechanism 14 is located in proximity to the print wheel 12 and together with print wheel 12 forms a print station. As will be explained in more detail hereinafter, the hammer mechanism 14 includes a hammer which is capable of a controllable, reciprocative movement whereby a hammer face thereof impacts a back surface of an elongated strip of label stock backing S to press one of a plurality of labels removably adhering to a front surface thereof and an interposed ink ribbon R against one of the raised elements on print wheel 12 to thereby imprint a character on the label.

The print stock including the label stock backing S is obtained from a print stock supply reel 16 which is rotatably supported on a shaft 18 mounted on base plate 10. From the print stock supply reel 16, the print stock is first drawn around a supply tension roller 20 also supported on base plate 10 and from there past a guide member 22, a print stock sensor 24, and a guide member 26 including the present invention, to the print station. Immediately after leaving the print station, the print stock is caused to change its direction by approximately 90° by a drive capstan 30 which presses the back surface print stock against a label stripping apparatus 28. The drive capstan 30 is rotated by a drive capstan motor, not illustrated, mounted below the base plate 10. The print stock is maintained in engagement with the drive capstan 30 by a pinch roller 32 pivoted on the base plate 10.

From the drive capstan 30, the print stock passes around a take-up tension roller 34 mounted on base plate 10 and then onto a take-up reel 36 which is rotatable on a shaft 38 of a take-up drive motor, not illustrated.

The ink ribbon R is similarly obtained from a ribbon supply reel 40 which is rotatable on a shaft 42 mounted on base plate 10. From the ribbon supply reel 40, the ink ribbon R passes around a supply roller 44, a guide pin 46, through the print station and to a guide pin 48, with supply roller 44, guide pin 46 and guide pin 48 all being mounted on base plate 10. From guide pin 48, the ink ribbon R passes around a drive capstan 50 which is rotated by a drive capstan motor, not illustrated, and is pressed against drive capstan 50 by a pinch roller 52 mounted on base plate 10. From drive capstan 50, the ink ribbon R is taken up on a ribbon take-up reel 54 which is rotatable with the shaft 56 of a ribbon driver motor, not illustrated.

As is conventional in the prior art, electronic control means is provided for controlling and coordinating the rotation of drive capstans 30, 50 to provide movement of the print stock and the ink ribbon past the print station. Electronic control means is likewise provided for coordinating the movement of the hammer within the hammer mechanism 14 with the rotation of print wheel 12 under control of timing signals obtained from print wheel 12 to provide imprinting of selected characters in succession on the labels removably adhering to the label stock backing S.

Referring now to FIGS. 2–5, the print stock is seen to include an elongated strip of label stock backing S having an upper edge surface S1, a lower edge surface S2, a front surface and a back surface. A plurality of labels L removably adhere to and are spaced along the front surface of the elongated strip. The print stock is caused to move in a predetermined path, by the elements previously described with respect to FIG. 1, from a supply position adjacent the stock sensor 24, around the guide member 26, through the print station including hammer mechanism 14 and print wheel 12, and around the label stripping apparatus 28. The hammer mechanism 14 comprises a support member 60, first and second guide plates 62, 66 secured to support member 60 in spaced-apart relation by a plurality of fasteners 68 (FIG. 4), and a hammer 64 located between first guide plates 62 and second guide plates 66 and supported by means not illustrated for reciprocative movement therebetween. Hammer 64 is caused to move by a solenoid and an arm assembly, not illustrated, in a predetermined plane parallel with guide plates 62 and 66 and impacts, at some point in its travel, the rear surface of the label stock backings to press the adjacent label and the interposed ink ribbon against one of the elements on the print wheel 12.

It will be seen that the predetermined path of travel of the print stock past the print station is substantially contained in a plane which is normal to the plane of movement of the hammer 64. The print stock itself is maintained normal to the plane of movement of hammer 64 by the back surface thereof engaging a rounded front surface of guide plate 62 adjacent hammer 64.

With particular reference to FIGS. 2 and 4, the vertical position of the print stock in the predetermined path of movement, and therefore the vertical alignment of the print stock with respect to the hammer 64, is established by the label stripping apparatus 28 including a base member 80 secured to the support member 60 of the hammer mechanism 14. The base member 80 has a substantially planar, horizontal reference surface 80A which is substantially normal to the plane of movement of the hammer 64 and against which the lower edge surface S2 of the label stock backing S is pressed. The label stripping apparatus 28 additionally includes a label stripping pin 86 extending at right angles from the plane of surface 80A and having a sufficiently small diameter to cause the labels L to separate from the front surface of the label stock backing S after imprinting as the back surface of the label stock backing S passes around pin 86.

In practice, it has been found that the label stock backing S tends to shift its vertical position relative to the hammer 64 by riding up or down on the pin 86 during movement of the label stock backing S along the predetermined path, with resultant misalignment of adjacent characters on the labels. In order to substantially eliminate this source of misalignment, the guide member 26 is provided for urging the lower edge surface 52 of the label stock backing S into contact with the horizontal reference surface 80A during movement of the label stock backing S along the predetermined path. The guide member 26 includes a base portion 26A in which is defined a channel 26B through which means may be passed for securing the guide member 26 to the base plate 10. In the embodiment illustrated, a pin 90 is provided which is affixed to and upstanding from the base plate 10 and which has a diameter slightly less than the width of channel **26*b*. A fastener 92 is also provided, one end of which is received in a threaded aperture in the base plate 10 adjacent to pin 90. When fastener 92 is rotated in a clockwise direction, its head engages an upper surface of base portion 26A to secure the guide member 26 to the base plate 10.**

Upstanding from the base portion 26A of guide member 26 is a guide portion having a substantially planar back surface 26C, a curved guide surface 26D, and a substantially planar side surface 26E. Substantially planar surfaces 26C and 26E extend in a vertical direction from base portion 26A when the guide member 26 is installed and their planes are therefore substantially normal to the plane of horizontal reference surface 80A.

Guide surface 26D, on the other hand, has an angle of inclination with respect to a normal drawn to the horizontal reference surface 80A which may be described with reference to the substantially vertical back surface 26C of guide member 26. Referring specifically to FIGS. 5–8, the angle of inclination of the guide surface 26D with respect to the back surface 26C, taken along the cross-sectional lines 6—6, 7—7 and 8—8, is seen to comprise progressively decreasing values *a*, *b* and *c*, with typical values being 5°, 2½°, and 0°, respectively. It will be seen, then, that the guide surface 26D accordingly has a predetermined angle of inclination with respect to a normal drawn to the horizontal reference surface 80A at the position along its length where the label stock backing S first comes into contact thereof when drawn from a supply position [line 6—6], and a zero angle of inclination with respect to such a normal at a position located along its length where the label stock guide backing passes out of contact therewith [line 8—8]. Such an arrangement has been found in practice to cause the label stock backing S to move downwardly in a vertical direction during movement from the supply position to the print station, thereby urging the lower edge surface S2 into contact with the horizontal reference surface 80A as desired.

It will also be seen that the pin 90 and fastener 92 have their centers aligned along a line extending at an angle of 45° from the predetermined path of label stock movement, and that the guide surface 26D is oriented with respect to the channel 26B so that the location of guide surface 26D may be adjusted with respect to the predetermined path of label stock movement.

It will be appreciated by those skilled in the art that the beneficial results provided by the invention may be achieved by other embodiments, such as by a guide member which includes a first guide surface located in proximity to the supply position and inclined with respect to a normal drawn to the horizontal reference surface 80A, and a second guide surface located intermediate the first guide surface and the print station and normal to the horizontal reference surface 80A. For example, the first and second guide surfaces could form portions of the surfaces of first and second, pins inclined as indicated.

Figure 5:
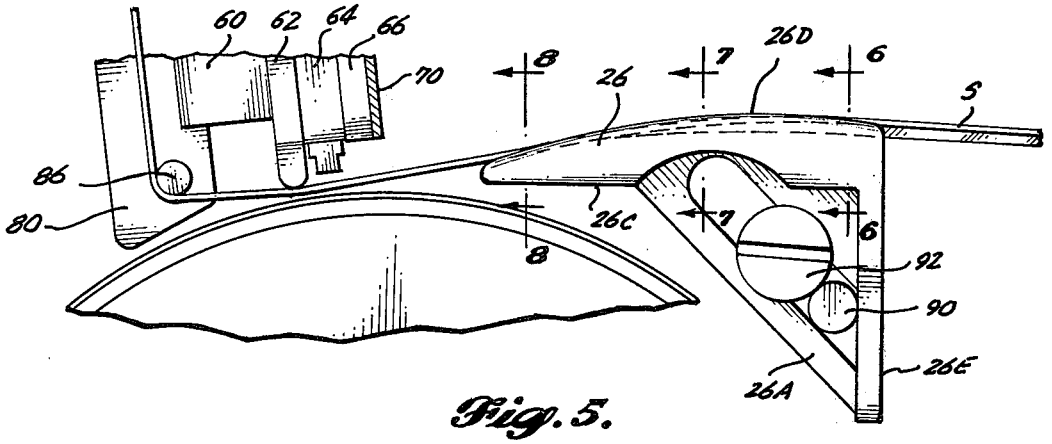
FIG. 5 is a magnified portion of the top plan view in FIG. 2.
Figure 6:
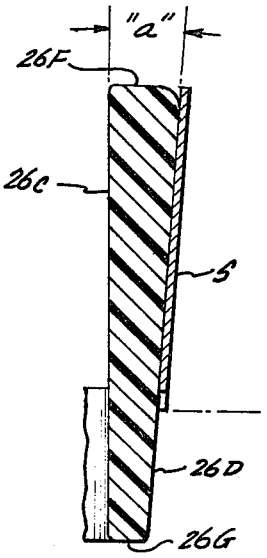
FIGS. 6, 7 and 8 are respective cross-sectional views of the improved guide means taken along the lines 6—6, 7—7 and 8—8 in FIG. 5.
Figure 7:
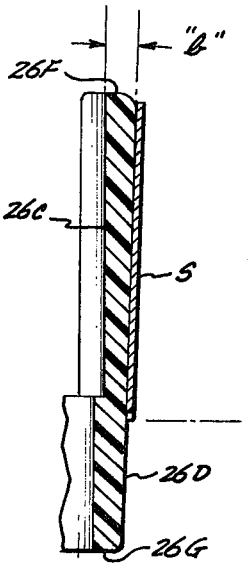
Figure 8:
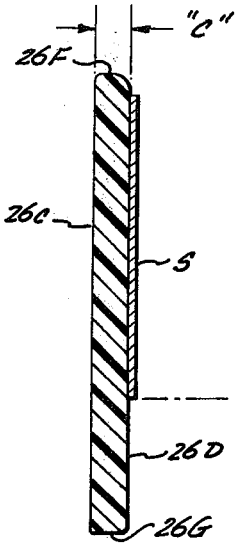

The preferred embodiment, however, includes, in addition to the first and second guide surfaces discussed above, what may be termed a transition surface intermediate the first and second guide surfaces whose angle of inclination with respect to a normal to the horizontal reference surface 80A varies between the first and second guide surfaces from a value substantially equal to that of the first guide surface to a value substantially equal to that of the second guide surface. In FIGS. 3 and 5, this transition surface comprises the portion of guide surface 26D intermediate the locations at which sections 6—6 and 8—8 are taken and forms an integral portion of the guide member 26. The provision of such an integral, continuous transition surface provides an advantage in avoiding any possible snagging of the labels positioned on the front surface of the label stock backing S that might be occassioned by physically separated, first and second guide surfaces.

A working model of the guide member 26 was constructed from a molded piece of glass-filled acetal resin. In order to properly define the aforementioned variation in angle of inclination, the working model of the guide member 26 included a guide surface 26D having a lower, horizontal edge 26G and an upper, horizontal edge 26F (FIG. 4) which were defined in plan view (such as the plan views of FIGS. 3, 5) by equiradial circles having a point of intersection in plan adjacent the second reference surface location (line 8—8) and having the centers of rotation offset in plan by an amount sufficient to produce the aforementioned angle of inclination at the first guide surface (line 6—6). In the working model, these equiradial circles had a radius of 2.40 inches with their centers of rotation offset by 0.06 inches in a *y*-direction, parallel to the intersection of surface 26E and the top surface of the guide member 26 [FIG. 3, 5], and by 0.21 in an *x*-direction orthogonal thereto. As a result, the angle of inclination of guide surface 26D, at 5° increments from a position coextensive with the second guide surface (line 8—8) to the first guide surface (line 6—6) was as follows: 0°, 1°4″, 1°50″, 2°24′, 3°20″, 3°50″, and 4°50″.

While the invention has been described with reference to a preferred embodiment thereof, it is to be understood by those skilled in the art of the invention is not limited thereto, but rather is intended bounded only by the limits of the appended claims.

I claim:

1. In an impact printer for use with print stock comprising an elongated strip having a lower edge surface, an upper edge surface, a front surface and a back surface, the impact printer including a print station including hammer means movable in a predetermined plane for imprinting characters on the print stock, and print stock drive means moving the print stock under tension along a predetermined path from a supply position past the print station to a take-up position, the improvement comprising:

a. first guide means located in proximity to the print station and to the predetermined path of print stock movement and including a substantially planar reference surface normal to the predetermined plane of movement of the hammer means, and b. second guide means located in proximity to the print station between the supply position and the print station for urging the lower edge surface of the print stock into contact with said reference surface during travel of the print stock along the predetermined path, said second guide means including a first guide surface having a predetermined angle of inclination of substantially 5° with respect to a normal to said reference surface, and a second guide surface which is located between said first guide surface and the print station, said second guide surface having a substantially zero angle of inclination with respect to a normal to said reference surface, said first and said second guide surfaces being located with respect to the predetermined path of the print stock so as to engage one of the front and back surfaces during movement thereof by the print stock drive means.

2. The improvement as recited in claim 1, further including means for adjusting the location of said second guide means with respect to the predetermined path of print stock movement.

3. An impact printer for use with print stock comprising an elongated strip having a lower edge surface, an upper edge surface, a front surface and a back surface, the impact printer including a print station including hammer means movable in a predetermined plane for imprinting characters on the print stock, and print stock drive means moving the print stock under tension along a predetermined path from a supply position past the print station to a take-up position, the improvement comprising:

a. first guide means located in proximity to the print station and to the predetermined path of print stock movement and including a substantially planar reference surface normal to the predetermined plane of movement of the hammer means, and b. second guide means located in proximity to the print station between the supply position and the print station for urging the lower edge surface of the print stock into contact with said reference surface during travel of the print stock along the predetermined path, said second guide means including a first guide surface having a predetermined angle of inclination with respect to a normal to said reference surface, said predetermined angle of inclination differing from zero, and a second guide surface which is located between said first guide surface and the print station, said second guide surface having a substantially zero angle of inclination with respect to a normal to said reference surface, said first and said second guide surfaces being located with respect to the predetermined path of the print stock so as to engage one of the front and back surfaces during movement thereof by the print stock drive means, said second guide means further including a transition surface extending between said first and said second guide surfaces, said transition surface having an angle of inclination with respect to a normal to said reference surface which varies between said first and said second guide surfaces from a value substantially equal to said angle of inclination of said first guide surface to a value substantially equal to said angle of inclination of said second guide surface.

4. The improvement as recited in claim 3, further including means for adjusting the location of said second guide means with respect to the predetermined path of print stock movement.

5. The improvement as recited in claim 3, wherein the angle of inclination of said transition surface decreases uniformly from said first to said second guide surface.

6. The improvement as recited in claim 5, wherein said first and said second guide surfaces and said transition surface comprise integral, contiguous portions of a single surface of said second guide means.

7. A guide means for aligning an elongated strip of print stock with respect to a print station of an impact printer, the elongated strip having a front surface and a back surface and being longitudinally moved in a predetermined direction to and from the print station by a print stock drive means, said guide means comprising a body having a base portion including means for permitting said guide means to be secured to the impact printer, and further having a guide portion upstanding from the integral with said base portion, said guide portion having a guide surface with first and second ends, either the front surface or the back surface of the elongated strip traversing said guide surface from said second end to said first end when moved by the print stock drive means in the predetermined direction when said guide means is secured to the impact printer, said guide surface at said first and said second ends being substantially planar, said guide surface at said second end having a predetermined angle of inclination with respect to a planar surface parallel to said substantially planar first end, said predetermined angle of inclination differing from zero, and said guide surface uniformly decreasing said angle of inclination from said second end to said first end in a direction of said guide surface parallel to the predetermined direction of elongated strip movement.

8. The guide means as recited in claim 7, wherein said predetermined angle of inclination is substantially 5°.

9. The guide means as recited in claim 7, wherein said guide surface is defined by an arbitrary line which is always normal to the predetermined direction of elongated strip movement thereacross and which uniformly varies its angle of inclination while moving from said first end to said second end in a direction of the guide surface parallel to the predetermined direction of elongated strip movement.

10. The guide means as recited in claim 7, wherein said guide surface has top and bottom edges extending parallel to each other between said first and second ends, and wherein said top and bottom edges are defined in plan by respective portions of first and second circles having a point of intersection in plan at said first end and having centers of rotation offset in plan from each other by an amount sufficient to produce said predetermined angle of inclination at said second end.

11. The guide means as recited in claim 10, wherein said first and said second circles are equiradial.

* * * * *